US005839513A

United States Patent [19]

Czirr

[11] Patent Number: 5,839,513

[45] Date of Patent: Nov. 24, 1998

[54] COMPRESSOR-ASSISTED ANNULAR FLOW

[75] Inventor: Kirk L. Czirr, Farmington, N. Mex.

[73] Assignee: Phillips Petroleum Company, Bartlesville, Okla.

[21] Appl. No.: 861,928

[22] Filed: May 22, 1997

[51] Int. Cl.[6] ..... E21B 43/12

[52] U.S. Cl. ..... 166/370; 166/267

[58] Field of Search ..... 166/370, 68, 267, 166/351, 357

[56] References Cited

U.S. PATENT DOCUMENTS

| | | | |
|---|---|---|---|
| 4,369,839 | 1/1983 | Freeman et al. | 166/53 |
| 4,509,599 | 4/1985 | Chenoweth et al. | 166/370 |
| 4,901,798 | 2/1990 | Amani | 166/311 |
| 5,050,676 | 9/1991 | Hes et al. | 166/267 |
| 5,076,360 | 12/1991 | Morrow | 166/267 |
| 5,441,365 | 8/1995 | Duffney et al. | 166/370 X |
| 5,547,021 | 8/1996 | Raden | 166/250.07 |
| 5,685,374 | 11/1997 | Schmidt et al. | 166/369 |

*Primary Examiner*—Frank Tsay
*Attorney, Agent, or Firm*—Lucas K. Shay

[57] ABSTRACT

An apparatus and a method for recovering hydrocarbon from a hydrocarbon producing well is provided. The apparatus comprises a two stage compression-assisted annular flow in which a first compression means is connected to a production tubing to flow gas and liquids, and a second compression means is connected to a tubing/casing annulus to flow gas at a relatively unrestricted flow rate.

15 Claims, 4 Drawing Sheets

COMPRESSOR-ASSISTED ANNULAR FLOW

FIELD OF THE INVENTION

This invention relates to an apparatus and a process for recovering hydrocarbon from a well and to a method for simultaneously producing hydrocarbon from the well through a tubing and a tubing/casing annulus.

BACKGROUND OF THE INVENTION

A hydrocarbon producing well typically includes two coaxial vertical conduits connecting the underground hydrocarbon reservoir to the surface. The outer conduit (casing) is set permanently in place while the inner conduit (tubing) is removable. The outer conduit is necessarily larger than the inner conduit. Typically, flow of hydrocarbon to the surface is through the inner conduit. However, in cases where the hydrocarbon reservoir has a large potential to produce both liquid and gases, the size of the inner conduit can significantly restrict the producing flow. In these cases, it is desirable that both gas and liquid flow through the annular space between the outer and inner conduits, providing a larger flow area and resulting in significantly less restriction to flow and higher flow rates. This is known as annular flow. A problem facing such annular flows relates to flow of separate liquid and gas phases where gas is the predominant phase. In order to flow liquid and gas vertically upward when gas is the predominant phase, the velocity of the gas phase must be high enough to lift all of the liquid to the surface (minimum lift velocity). If the gas velocity is too low, liquid will accumulate in the bottom of the annular space and restrict gaseous flow. Under annular flow conditions with the large flow area, gas velocities are minimized creating the potential for liquid accumulation. This liquid accumulation can ultimately shut off virtually all gas flow.

Therefore, there is an ever-increasing need to develop an apparatus and a method for recovering hydrocarbon through the tubing/casing annulus. It would also be a significant contribution to the art to provide such an apparatus and a method for flowing a hydrocarbon simultaneously through the larger outer conduit and the smaller inner conduit.

SUMMARY OF THE INVENTION

An object of this invention is to provide an apparatus which is useful for recovering a hydrocarbon such as, for example, methane. Another object of this invention is to provide an apparatus which is useful for simultaneously producing hydrocarbon gas and liquid. Also an object of this invention is to provide a method for recovering a hydrocarbon. A further object of this invention is to provide a method for recovering gas from gas wells that also produce a liquid such as, for example, water. An advantage of this invention is that the apparatus and method of this invention can maximize gaseous hydrocarbon production by flowing the majority of the gas from a well up the less restrictive annulus at reduced back pressure relative to the surface gathering or flow line pressure while simultaneously flowing the majority of liquid up the tubing. Other objects and advantages will become more apparent as this invention is more fully disclosed hereinbelow.

According to a first embodiment of this invention, an apparatus useful for recovering a hydrocarbon fluid is provided which comprises: (a) a casing fixed in a wellbore, wherein the casing extends from the surface to a desired depth in the wellbore; (b) a production tubing having a smaller diameter than the casing, wherein the tubing is positioned in coaxial alignment with the casing to form a tubing casing annulus; the tubing extends above the casing to provide a surface outlet for the tubing; the tubing casing annulus extends from the surface for fluid communication with a producing formation at its lower end; and both the tubing outlet and the tubing/casing outlet at the surface are in fluid communication with the producing formation; (c) a first compression means located on the surface and having an inlet and an outlet; (d) a second compression means located on the surface and having an inlet and an outlet; (e) a first conduit means for connecting the surface outlet of the tubing to the inlet of the first compression means; (f) a second conduit means for connecting the surface outlet of the tubing/casing annulus to the inlet of the second compression means; (g) a third conduit means for connecting the outlet of the first compression means to the inlet of the second compression means; and (h) a fourth conduit means for connecting the outlet of the second compression means to a surface gas gathering system.

According to a second embodiment of this invention, a method which can be used for recovering hydrocarbon fluid is provided. The method comprises: (a) providing an inner conduit designated a production tubing into a producing formation of a hydrocarbon-producing well within and in coaxial arrangement with an outer conduit thereby forming a tubing/casing annulus; (b) securely connecting a first compression means to the inner conduit; (c) securely connecting a second compression means to the tubing/casing annulus; and (d) recovering the hydrocarbon through the inner conduit and the tubing/casing annulus using the first and second compression means wherein the casing extends from the surface to a desired depth in the wellbore; the production tubing has a smaller diameter than the casing; the tubing extends above the casing to provide a surface outlet for the tubing; the tubing/casing annulus extends below the surface for fluid communication with a producing formation at its lower end; and both the tubing outlet and the tubing/casing outlet at the surface is in fluid communication with the producing formation.

BRIEF DESCRIPTION OF THE DRAWINGS

FIG. 2 illustrates normal gas recovery through the inner conduit (tubing) wherein the tubing/casing annulus is shut-in.

FIG. 3 shows recovery of gas through the tubing/casing annulus or annular flow wherein the inner conduit is shut-in.

DETAILED DESCRIPTION OF THE INVENTION

According to the first embodiment of this invention, an apparatus that can be used to recover a hydrocarbon is provided. The apparatus can comprise, consist essentially of, or consist of (a) a casing fixed in a wellbore, wherein the casing extends from the surface to a desired depth in the wellbore; (b) a production tubing having a smaller diameter than the casing, wherein the tubing is positioned in coaxial alignment with the wellbore to form a tubing casing annulus; the tubing extends above the casing to provide a surface outlet for the tubing; the tubing casing annulus extends from the surface for fluid communication with a producing formation at its lower end; and both the tubing outlet and the tubing/casing outlet at the surface are in fluid communication with the producing formation; (c) a first compression means located on the surface and having an inlet and an outlet; (d) a second compression means located on the surface and having an inlet and an outlet; (e) a first conduit means for connecting the surface outlet of the tubing to the inlet of the first compression means; (f) a second conduit means for connecting the surface outlet of the tubing/casing annulus to the inlet of the second compression means; (g) a third conduit means for connecting the outlet of the first compression means to the inlet of the second compression means; and (h) a fourth conduit means for connecting the outlet of the second compression means to a surface gas gathering system. The presently preferred hydrocarbon is natural gas. The term "fluid" refers to, unless otherwise indicated, gas, liquid, or both. The term "liquid" can be water, gas condensate, or mixtures thereof. The term "water" denotes pure water, a solution, or a suspension.

Figure 1:
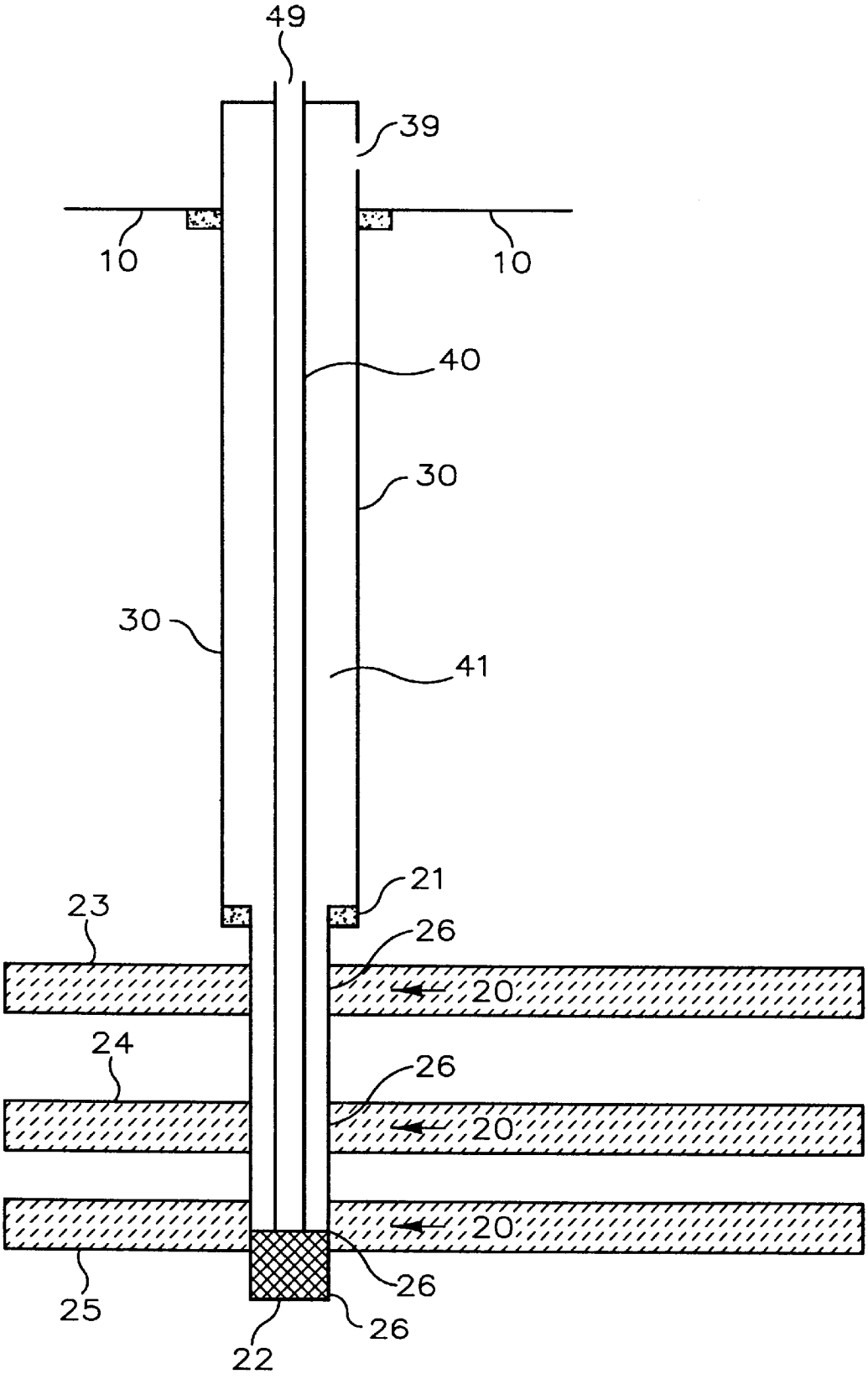
FIG. 1 shows a typical wellbore.

A typical hydrocarbon reservoir (well) is shown in FIG. 1. A casing 30 is inserted from the surface 10 of the well through the producing formation 20 along the well to form the outer conduit 30, having a surface outlet 39, and to maintain the integrity of the well. Depending on the well and formation, the diameter of the outer conduit 30 can be in the range of from about 3 to about 20 inches. The portion of the casing, extending from the casing shoe 21 or top of the producing formation to the bottom 22 of the producing formation can be somewhat smaller in diameter than that of the casing above 21. For illustrative purposes, a formation as shown in FIG. 1 can also comprise top coal interval 23, middle coal interval 24, and bottom interval 25. Gas and liquid from the producing formation 20 flow toward the casing and into the outer conduit through perforated casing or casing liner 26. A tubing string (inner conduit) 40, having a surface outlet 49, is then inserted, within and coaxially aligned with the outer conduit 30, from the surface 10 to the producing formation 20 to form a tubing/casing annulus 41.

Figure 2:
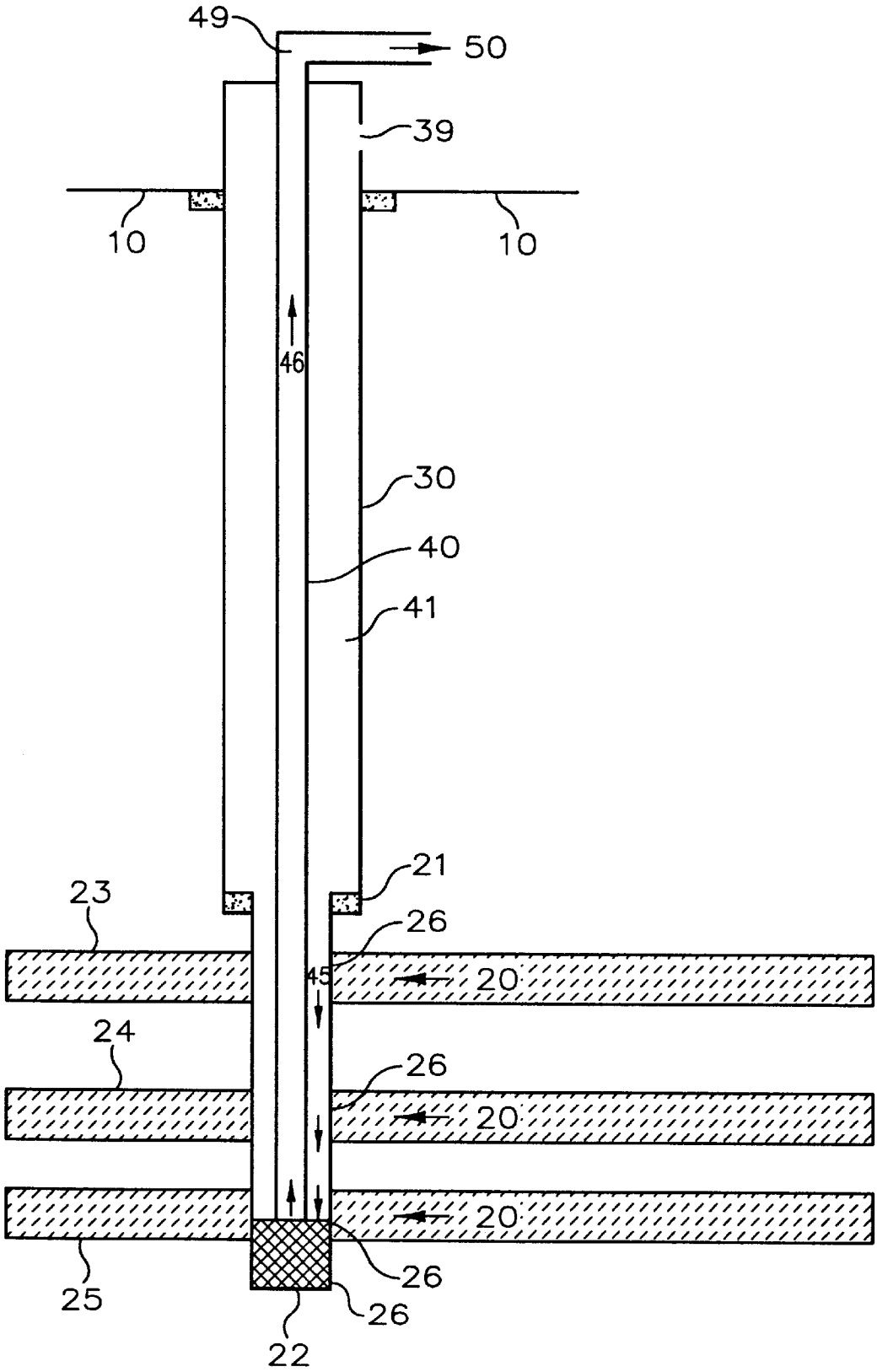

FIG. 2 shows a method for recovering hydrocarbon from a gas well. In this method, the tubing/casing annulus 41 is shut in at the surface outlet 39. Gas and liquids in which the liquid can include gas condensates and water flow from the producing formation 20 through the perforated casing 26 by first forming a downward flow 45 in the annulus 41 and then up into the tubing 40 to form an upward flow 46 to the surface gathering assembly 50.

Figure 3:
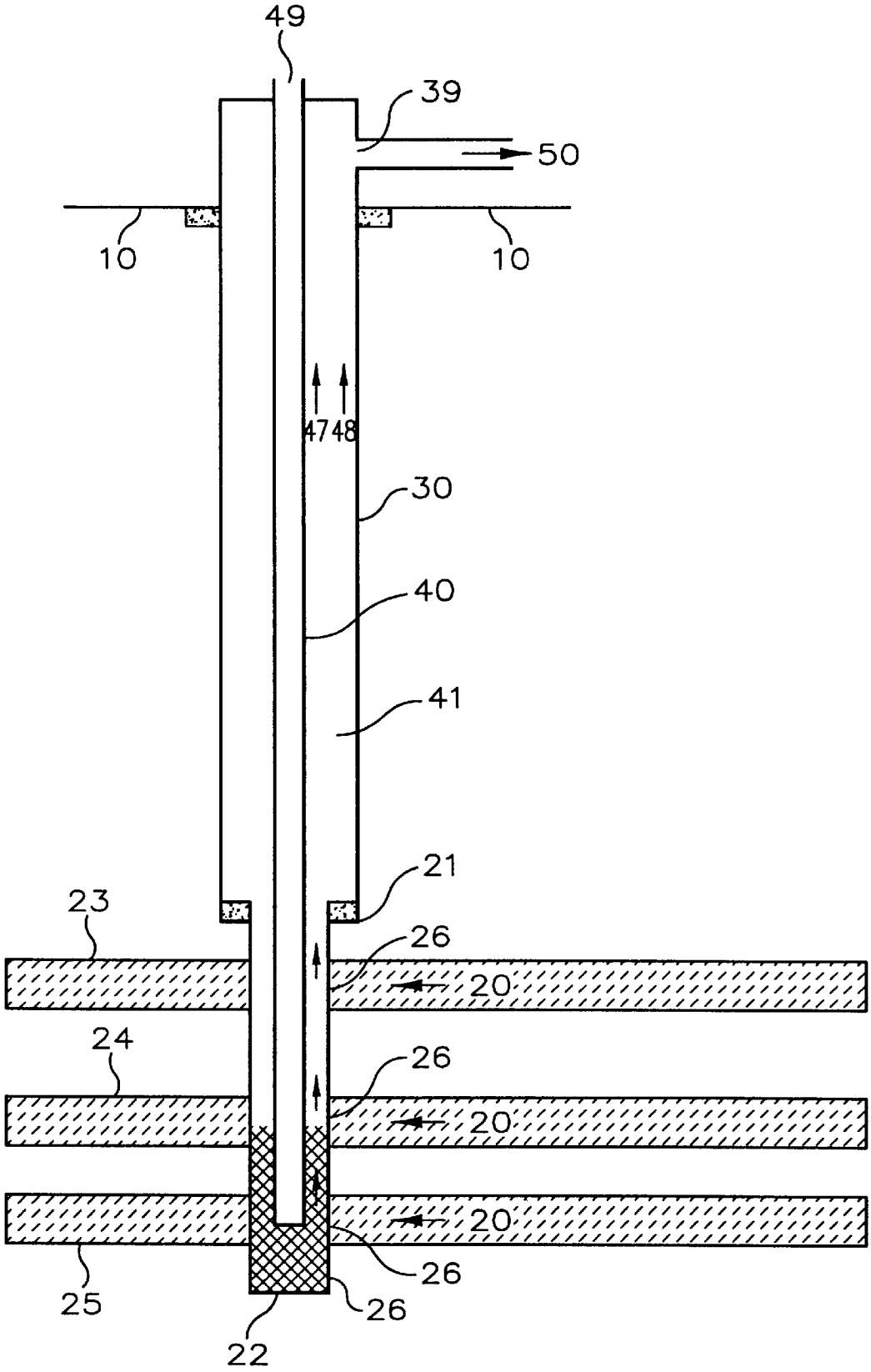

However, when the formation produces a large quantity of fluid, the small tubing significantly restricts the flow. FIG. 3 illustrates the recovery of hydrocarbon through an annular flow. In annular flow, the tubing at the surface outlet 49 is shut in thereby allowing the gas and liquids to flow from the producing formation 20 through the perforated casing 26 to form an upward flows of 47 (gas) and 48 (gas condensates and water) in the tubing/casing annulus 41 and to the surface gathering assembly 50.

As disclosed hereinabove, a problem related to the annular flow is the separate gas phase 47 and liquid phase 48, wherein the gas phase is predominant. Under such a condition, the velocity of the gas phase must be high enough to lift all liquid to the surface. If the gas velocity is not high enough, liquids will accumulate in the bottom of the annular space thereby restricting the flow of both gas 47 and liquid 48 and ultimately shutting off virtually all gas flow.

Figure 4:
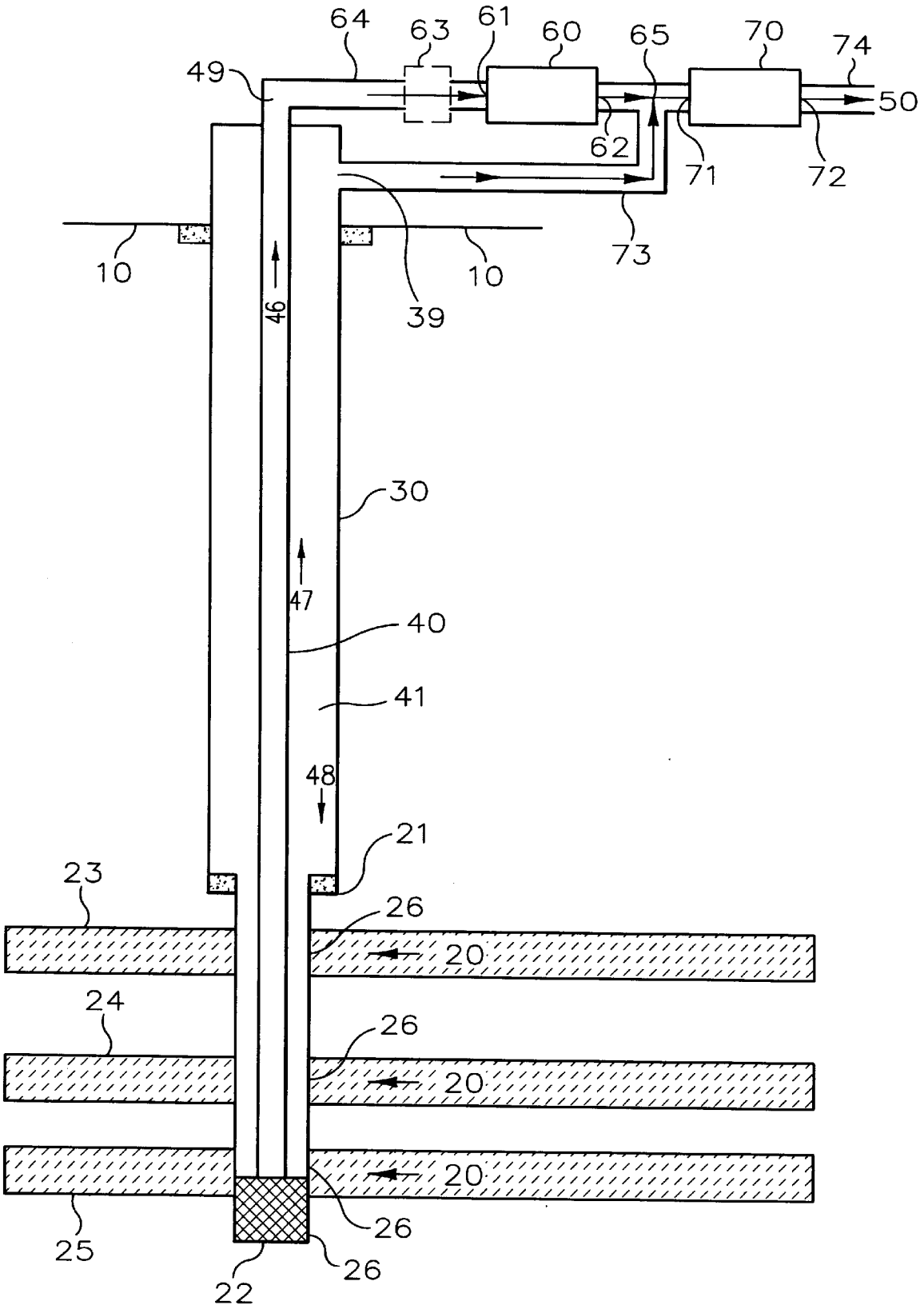
FIG. 4 illustrates a compressor-assisted annular flow in which the gas is recovered through both inner conduit and tubing/casing annulus according to the invention.

According to the present invention, an apparatus that allows gas and liquid flow simultaneously through the tubing and the tubing/casing annulus is provided. A simple version of the apparatus is shown in FIG. 4. A first compression means 60 having an inlet 61 and an outlet 62 is located on the surface 10. The inlet 61 of the compression means 60 is connected to the outlet 49 of the tubing (inner conduit) 40 using conduit means 64. Inlet 61 is the suction side of the compression means 60 which, when connected to the tubing outlet 49, aids the continuous removal of a majority of water produced from the well (flow 46) through tubing 30. Generally, the compression means 60 also comprises a gas-liquid separator allowing the separation and removal of liquids from gas thereby allowing only gas phase to enter the compression means 60. Optionally, a separate liquid-gas separator 63 can be fixedly located between the surface outlet 49 of the tubing 40 and the inlet 61 of the compressions means 60 by using suitable conduit means. The gas phase is discharged through the outlet 62 of the compression means 60. The discharged gas 65 of compression means 60 is connected, through the third conduit means 66 to the inlet 71 of a second stage compression means 70, which also comprises an outlet 72 to discharge gas to surface gas gathering system 50.

The inlet 71 of the second compression means 70 is also connected to the surface outlet 39 of the tubing/casing annulus 30 by a second conduit means 73. The conduit means 73 is connected to, and is in fluid communication with, the conduit means 66. As such, the gas flow 47 produced through the tubing/casing annulus 41 and the discharged gas 65 from the compression means 60 enter the inlet 71 of the compression means 70 through the conduit means 66. The gas discharged from the outlet 72 of the compression means 70 can be transported to a surface gas gathering assembly 50 through a fourth conduit means 74. An optional gas-liquid separator (not shown in FIG. 4) can also be installed between the surface outlet 39 and the inlet 71 of the compression means 70.

According to the present invention, a majority of gas 47, including water vapor, flows up the tubing/casing annulus and water 48 falls to the bottom of the formation. In the mean time, flow 46 which includes a majority of water produced in the well and gas flows up the tubing 40.

Also according to the present invention, the first compression means, or the second compression means, or both, can also comprise a multistage compressor. A multistage compression refers to two or more compressors.

According to the second embodiment of this invention, a method for producing a hydrocarbon is provided. In the first step of the method, a casing 30 is inserted, extending from the surface 10, into the producing formation 20 of a hydrocarbon-producing well by any methods known to one skilled in the art. Thereafter, an inner conduit designated as tubing 40 is inserted, from the surface 10, into the producing formation 20 of the hydrocarbon-producing well. The tubing 40 is inserted such that it is within and in coaxial alignment with the casing 30. Upon the insertion of tubing 40, a tubing/casing annulus 41 is formed.

Thereafter, a first compression means 60 is securely connected to the surface outlet 49 of the tubing 40 through a first conduit means 64. Optionally, if the compression means 60 does not comprise a liquid-gas separator, a separate liquid-gas separator 63 can be installed between the surface outlet 49 and the inlet 61 of the compression means 60. A second compression means 70 is then securely connected to the surface outlet 39 of the tubing/casing annulus 41 using a second conduit means 73. The hydrocarbon can simultaneously be recovered through the tubing 40 and the tubing/casing annulus 41. Gas and water flow up the tubing 40, aided by the action of the compression means 60, are separated by the gas-liquid separator of the compression means 60 or by the optional separator 63. Produced gas then enters the compression means 60 and is discharged at the outlet 62 forming gas flow 65. Gas containing relatively small quantity of water vapor flows up in the tubing/casing annulus as flow 47 by the action of the compression means 70. In an aspect of this invention, the pressure of discharged gas flow 65 is higher than that of the flow 46 and can be so adjusted that equalizes the pressure of the flow 47. Such pressure adjustment can be done, for example, by varying the rotational speed of the compression means 60.

The method of this invention can have special applications to high rate gas wells that also produce liquids. The method can maximize well production because the majority of the gas flows up the less restrictive annulus at reduced back pressure relative to surface gathering or flow line pressure. The second stage compression means is efficient because the vast majority of the back pressure reduction achieved at the surface is transferred to the bottom of the wellbore without friction losses, resulting in the lowest economically feasible flowing bottom hole pressure. At the same time, gas and associated fluids are produced through the inner conduit at sufficient velocity to prevent fluid loading problems. Performing the above operations with a two stage compression provides maximum operational flexibility since the compression means horsepower can be reallocated as necessary between the two compression stages.

That which is claimed is:

1. An apparatus comprising:

(a) a casing fixed in a wellbore, wherein the casing extends from the surface to a desired depth in the wellbore;

(b) a production tubing having a smaller diameter than the casing; wherein the tubing is positioned within, and in coaxial alignment with, said casing to form a tubing/casing annulus; said tubing extends above said casing to provide a surface outlet for said tubing and is in fluid communication with a producing formation; and said tubing/casing annulus extends below the surface for fluid communication with said producing formation at its lower end, and has a tubing/casing outlet at the surface which is in fluid communication with said producing formation;

(c) a first compression means located on the surface having an inlet and an outlet;

(d) a second compression means located on the surface having an inlet and an outlet;

(e) a first conduit means for connecting the surface outlet of said tubing to the inlet of said first compression means;

(f) a second conduit means for connecting the surface outlet of said tubing/casing annulus to the inlet of said second compression means; and (g) a third conduit means for connecting the outlet of said first compression means to the inlet of said second compression means.

2. An apparatus according to claim 1 further comprising a fourth conduit means for connecting the outlet of said second compression means to a surface gas gathering system.

3. An apparatus according to claim 1 wherein the pressure at the inlet of said first compression means is lower than the pressure at the inlet of said second compression means.

4. An apparatus according to claim 1 further comprising a means for equalizing with the pressure of the gas flow in said tubing/casing annulus and the pressure at the outlet of said first compression means.

5. An apparatus according to claim 1 wherein the pressure at the outlet of said first compression means equalizes with the pressure of the gas flow in said tubing/casing annulus.

6. An apparatus according to claim 1 wherein said first compression means comprises a multistage compressor.

7. An apparatus according to claim 1 wherein said second compression means comprises a multistage compressor.

8. An apparatus according to claim 1 wherein each of said first compression means and said second compression means comprises a multistage compressor.

9. An apparatus comprising:

(a) a casing fixed in a wellbore, wherein the casing extends from the surface to a desired depth in the wellbore;

(b) a production tubing having a smaller diameter than the casing; wherein the tubing is positioned within, and in coaxial alignment with, said casing to form a tubing/casing annulus; said tubing extends above said casing to provide a surface outlet for said tubing and is in fluid communication with a producing formation; and said tubing/casing annulus extends below the surface for fluid communication with said producing formation at its lower end, and has a tubing/casing outlet at the surface which is in fluid communication with said producing formation;

(c) a first compression means located on the surface having an inlet and an outlet;

(d) a second compression means located on the surface having an inlet and an outlet;

(e) a first conduit means for connecting the surface outlet of said tubing to the inlet of said first compression means;

(f) a second conduit means for connecting the surface outlet of said tubing/casing annulus to the inlet of said second compression means; and (g) a third conduit means for connecting the outlet of said first compression means to the inlet of said second compression means; and (f) a fourth conduit means for connecting the outlet of said second compression means to a surface gas gathering system.

10. A method comprising: (a) providing an inner conduit designated a production tubing into a producing formation of a hydrocarbon-producing well within and in coaxial arrangement with an outer conduit thereby forming a tubing/casing annulus wherein said outer conduit is formed by a well casing; (b) securely connecting a first compression means to said inner conduit; (c) securely connecting a second compression means to said tubing/casing annulus; and (d) recovering the hydrocarbon through said inner conduit and said tubing/casing annulus using said first compression means and said second compression means wherein said casing extends from the surface to a desired depth in said well; said production tubing has a smaller diameter than said casing; said production tubing extends above said casing to provide a surface outlet for said production tubing; said tubing/casing annulus extends below the surface for fluid communication with said producing formation at its lower end; and both the production tubing outlet and the tubing/casing outlet at the surface is in fluid communication with said producing formation.

11. A method according to claim 10 wherein the pressure at the inlet of said first compression means is lower than the pressure at the inlet of said second compression means.

12. A method according to claim 10 wherein the pressure at the outlet of said first compression means equalizes with the pressure of the gas flow in said tubing/casing annulus.

13. A method according to claim 10 wherein said first compression means comprises a multistage compressor.

14. A method according to claim 10 wherein second compression means comprises a multistage compressor.

15. An apparatus according to claim 10 wherein each of said first compression means and said second compression means comprises a multistage compressor.

* * * * *